US005246113A

United States Patent [19]

Schuster

[11] Patent Number: 5,246,113

[45] Date of Patent: Sep. 21, 1993

[54] CARRIER FOR STACKED ARTICLES

[75] Inventor: Richard L. Schuster, Monroe, La.

[73] Assignee: Riverwood International Corporation, Atlanta, Ga.

[21] Appl. No.: 958,882

[22] Filed: Oct. 9, 1992

Related U.S. Application Data

[63] Continuation-in-part of Ser. No. 834,892, Feb. 11, 1992.

[51] Int. Cl.[5] ..... B65D 65/00; B65D 75/00

[52] U.S. Cl. ..... 206/430; 206/160; 206/194; 206/197; 206/821

[58] Field of Search ..... 206/160, 194, 196, 199, 206/427, 430, 394, 161, 197, 593, 821

[56] References Cited

U.S. PATENT DOCUMENTS

| | | | |
|---|---|---|---|
| 2,699,866 | 1/1955 | Russell | 206/394 |
| 3,085,683 | 4/1963 | Harrison | 206/161 |
| 3,200,944 | 8/1965 | Rapata | 206/161 |
| 3,224,576 | 12/1965 | Whiteford | 206/161 |
| 3,227,272 | 1/1966 | Critzer | 206/394 |
| 3,351,264 | 11/1967 | Bostrom | 206/593 |
| 3,443,685 | 5/1969 | Wanderer | 206/161 |
| 3,601,253 | 8/1971 | Poupitch | 206/197 |
| 4,593,818 | 6/1986 | Schenkman | 206/821 |
| 4,638,941 | 1/1987 | Watson | 206/821 |
| 4,712,676 | 12/1987 | Randall | 206/593 |
| 4,739,884 | 4/1988 | Duplessy | 206/430 |
| 4,848,573 | 7/1989 | Salacuse | 206/427 |
| 4,896,774 | 1/1990 | Hammett et al. | 206/427 |

FOREIGN PATENT DOCUMENTS

| | | | |
|---|---|---|---|
| 955883 | 4/1964 | United Kingdom | 206/821 |

*Primary Examiner*—David T. Fidei

[57] ABSTRACT

A carrier containing a plurality of layers of articles, such as beverage cans, arranged in stacked end-to-end fashion. The carrier is fully enclosed and is formed with overlapping top panel flaps which produce an area of double thickness between handle openings in the flaps. A reinforcing sheet on the underside of the top panel in the double layer area protects against tearing, while stress relief lines in the form of score lines extending from the ends of the handle opening to the corners of the carrier provide for distribution of lifting and carrying stresses. A separator sheet preventing direct contact between stacked articles extends between layers and may include distortable areas aligned with the articles. Downward pressure on the upper layer causes the bottom of an article to force the distortable area into a recess in the top of the next lower article.

12 Claims, 6 Drawing Sheets

CARRIER FOR STACKED ARTICLES

CROSS REFERENCE TO RELATED APPLICATION

This application is a continuation-in-part of application Ser. No. 07/834,892 filed Feb. 11, 1992.

FIELD OF THE INVENTION

This invention relates to carriers which are adapted to carry a plurality of articles. More particularly, it relates to a carrier which is adapted to carry a plurality of layers of articles in stacked end-to-end relationship.

BACKGROUND OF THE INVENTION

Sleeve-type carriers are commonly used to package beverage cans and other types of articles, and are typically formed from paperboard blanks which have been folded into collapsed sleeve form. Each collapsed sleeve is opened by a packaging machine, after which cans or other articles are introduced through one or both of the open ends of the sleeve and the end panel flaps are folded and secured together. The cans are normally introduced in upright position while the carrier sleeve is supported on one of its side panels, with the open ends of the sleeve facing out to receive the cans. The resulting carrier therefore contains a layer of cans the ends of which are located adjacent the side panels of the carrier. Additionally, a handle is normally incorporated into the top panel of the carrier to facilitate lifting and carrying.

Although such carriers have been designed to contain varying numbers of articles, conventional packages for carrying beverage cans normally hold six or twelve cans. This is partly because a conventional sleeve-type carrier would be quite long when made large enough to handle large numbers of cans, such as twenty-four, and would be unwieldy to carry. Further, the heavy load caused by the cans would tend to promote tearing in the handle area.

Since it would be highly advantageous to have a sleeve-type carrier capable of holding a large number of articles, and capable of resisting tearing when lifted and carried, it is an object of the invention to provide such a carrier.

BRIEF SUMMARY OF THE INVENTION

The carrier of the invention, which achieves the goal set out above, is designed to receive a plurality of layers of stacked articles. Thus, instead of the usual single layer of articles arranged with their ends adjacent the side panels of the carrier, the invention incorporates a plurality of layers of articles, with the ends of the articles in one layer being adjacent the ends of the articles in the next layer. Moreover, the ends of the articles in the end layers are adjacent the top and bottom panels instead of the side panels. This results in the ability to carry more articles by only slightly increasing the overall dimensions of the carrier and lends itself to the use of a carrier handle which is capable of withstanding the increased load.

In one aspect of the invention, the top panel of the carrier preferably is comprised of an inner flap connected to the upper edge of one of the side panels along a fold line and an outer flap connected to the upper edge of the other side panel. In a preferred embodiment, each of the inner and outer flaps has an edge remote from the side panels and each flap contains a handle opening spaced from the remote edge thereof. The outer flap overlaps the inner flap to form an area of double thickness extending between the handle openings. The resulting suitcase style handle facilitates carrying the slightly wider package of the invention. Reinforcing means are provided in the area of double thickness for reinforcing the area against tearing, and stress relief lines are provided in the top panel extending outwardly from the handle openings to distribute lifting stresses.

In a preferred embodiment the stress relief lines comprise score lines extending from each handle opening to the nearest side panel, preferably to the corners of the top panel, and the reinforcing means comprises a sheet adhered to one of the top panel flaps, the sheet including a folded edge substantially aligned with a side edge of the handle opening in the outer top panel flap. Further, the end panels are comprised of end flaps foldably connected to the top, bottom and side panels, the end flap connected to the top panel comprising two overlapped flaps segments, whereby the overlapped flaps comprise an extension of the overlapped top panel flaps.

Due to the stacked arrangement of the articles in the carrier, the carrier is of a shape and size which makes lifting by means of the handle a relatively simple task, even though the contents of the carrier may be quite heavy.

In another aspect of the invention, the carrier includes a separator sheet between the layers of articles. The bottom ends of articles in an upper layer and the top ends of articles in the next lower layer are aligned in end-to-end relationship and contact portions of the separator sheet. In one embodiment the separator sheet is substantially planar, while in another embodiment the portions of the separator sheet contacted by the bottom ends of articles are below the primary plane of the separator sheet. One method of fabrication involving the latter type of separator sheet employs a sheet having distortable portions which overlie the tops of the articles in the lower layer. The sheet is placed on the top ends of articles in a lower layer and a group of similar articles are placed on the separator sheet to form an upper layer, with the bottom ends of the articles in the upper layer contacting the distortable portions of the separator sheet. By applying a force to the articles in the upper layer the bottom ends of the articles distort the distortable portions of the separator sheet, causing the contacted portions to move to a position below the plane of the separator sheet. The stacked layers then become part of a carrier, as by introducing them into a carrier sleeve through an open end of the sleeve.

The invention is particularly applicable to articles capable of being nested, such as beverage cans wherein one end is narrower than the other and the wider end is of recessed construction. With such an arrangement the bottom ends of the articles in the upper layer and the portions of the separator sheet below the general plane of the separator sheet extend into the recesses of the upper ends of the articles in the lower layer. The distortable portions of the separator sheet include transverse panel portions connected to the separator sheet by a fold line, with spaced slits extending inwardly from the fold line to divide the transverse panel portions into segments.

These and other features and aspects of the invention, as well as other benefits, will readily be ascertained from the detailed description of the preferred embodiment described below.

DETAILED DESCRIPTION OF THE PREFERRED EMBODIMENT

Figure 1:
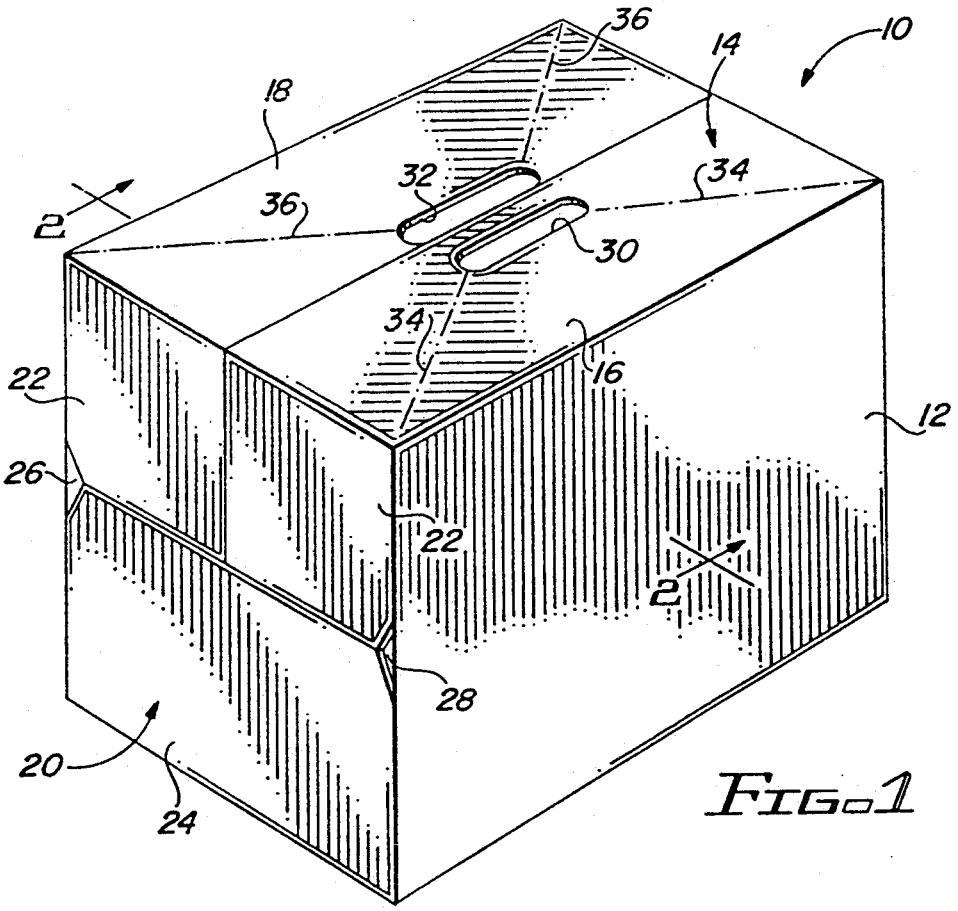
FIG. 1 is a pictorial view of the carrier of the invention.

Referring to FIG. 1 of the drawing, the carrier 10 is comprised of side panels 12 foldably connected to top panel 14 and to the bottom panel, not visible in this view. The top panel is comprised of two top panel flaps 16 and 18, described more fully below. End panels 20 connect the top, bottom and side panels and are comprised of end panel flaps 22 and 24 adhered to dust flaps 26 and 28, wherein the end panel flaps are foldably connected to the top and bottom panels and the dust flaps are foldably connected to the side panels. Spaced handle openings 30 and 32 are provided in the top panel and extend along the length of the carrier substantially parallel to the side panels. Score lines 34 extend from the ends of handle opening 30 to the nearest corners of the carrier, while score lines 36 extend from the ends of handle opening 32 to the other corners of the carrier.

Figure 2:
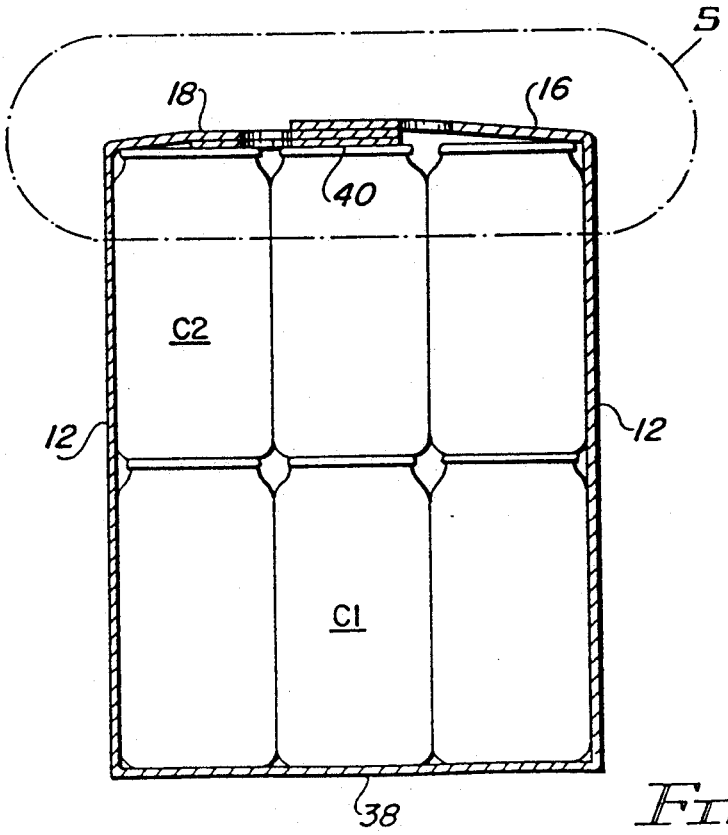
FIG. 2 is a vertical sectional view taken along line 2—2 of FIG. 1.
Figure 3:
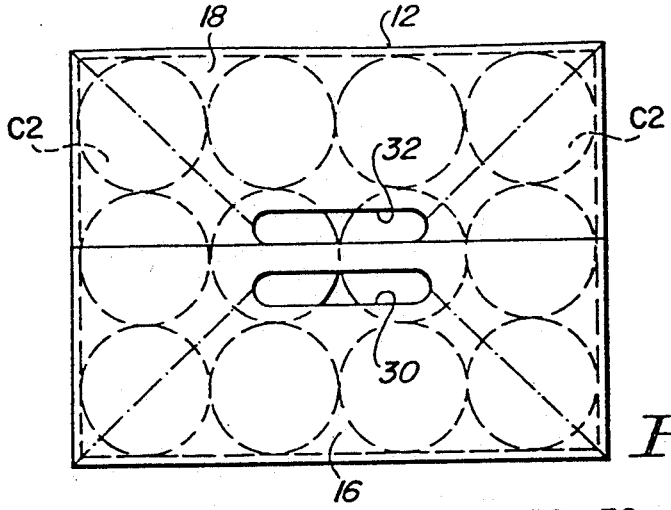
FIG. 3 is a plan view of the carrier of FIG. 1.

As shown in FIGS. 2 and 3, the carrier contains a bottom layer of articles, shown for purpose of illustration as beverage cans C1, and an upper layer of articles, shown as cans C2, in stacked relationship. The lower ends of the upper cans C2 thus are supported on the upper ends of the bottom cans C1, with the bottom cans resting on the bottom panel 38. The top panel 14 is closely adjacent, and preferably is in contact with, the tops of the cans C2 to provide for a tight fit between the cans and the carrier. As shown in FIG. 3, the top layer of cans is made up of twelve cans arranged in three rows of four cans. Since the bottom layer is identically arranged, the total number of cans in the carrier is twenty-four. As illustrated in FIG. 2, the top panel is reinforced between the handle openings as indicated by numeral 40, the details of which are explained hereinafter.

Figure 4:
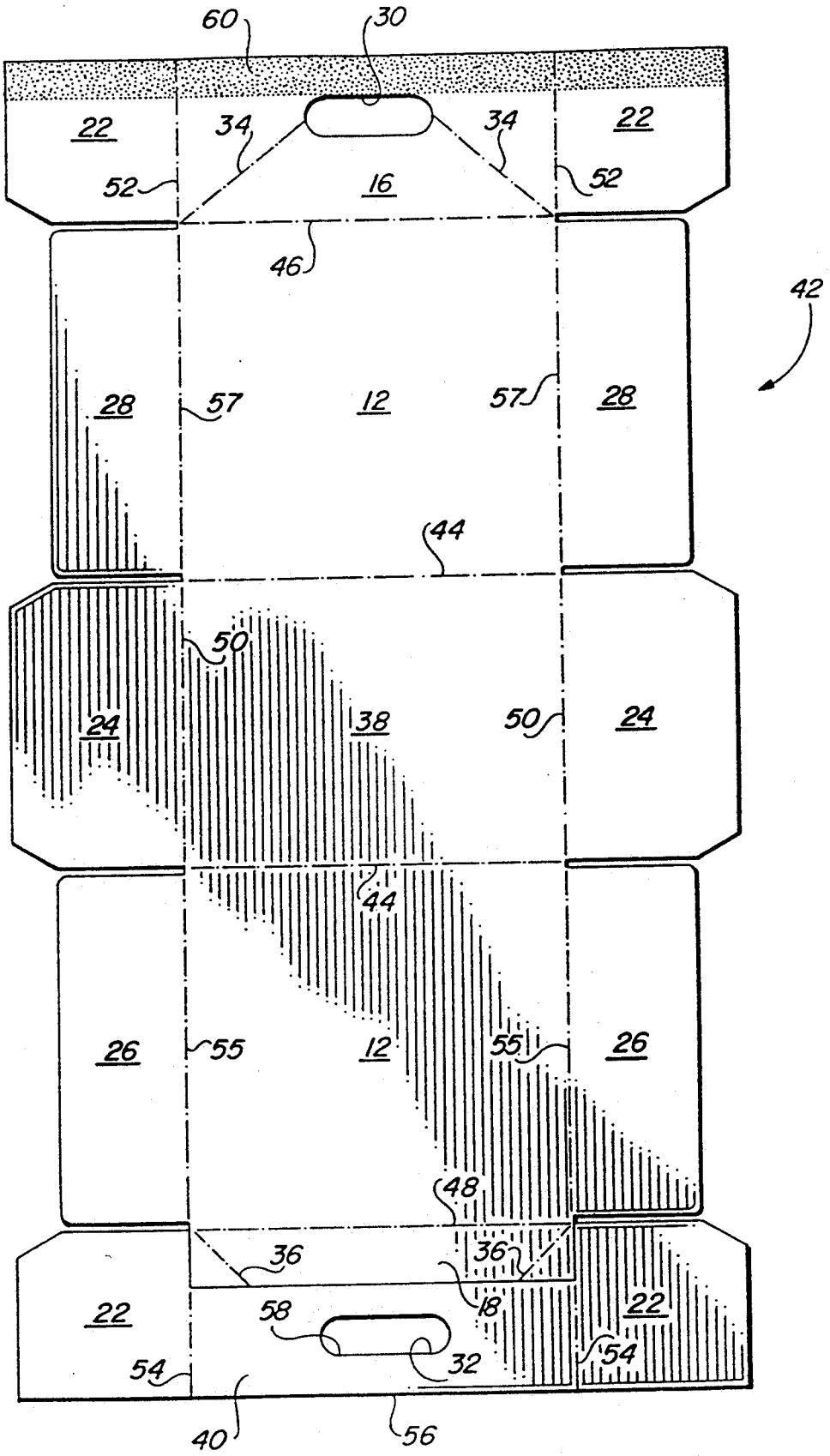
FIG. 4 is a plan view of a blank for fabricating the carrier of FIG. 1.

Referring now to FIG. 4, the carrier 10 of FIG. 1 is formed from the blank 42, wherein portions corresponding to similar elements of the carrier are identified by the same reference numerals. The blank 42 is a single sheet of material, preferably paperboard, comprising a centrally located bottom panel section 38 connected to the side panel sections 12 along fold lines 44. The outer top panel flap is connected to one of the side panel sections 12 along fold line 46, while the inner top panel flap 18 is connected to the other side panel section 12 along fold line 48. End panel flaps 24 are connected to the bottom panel section 38 along fold lines 50, and end panel flaps 22 are connected to the outer and inner top panel flaps 16 and 18 along fold lines 52 and 54, respectively. Inner or dust flaps 26 and 28 are connected to the side panel sections 12 along fold lines 55 and 57, respectively. In addition, the reinforcing means 40 of FIG. 2 comprises a sheet adhered to the inner top panel flap 18 so as to terminate at the free edge 56 of the inner top panel flap. It is preferred that the reinforcing sheet entirely cover the area which includes the handle opening 32, requiring the sheet to have a corresponding cutout 58 to enable the fingers of a user to penetrate the top panel when lifting the carrier, but in any event the sheet should at least extend to the outer edge of the cutout 32 in order to provide extra thickness in the handle strap portion. It will be appreciated that the inner surface of the blank is facing the viewer in FIG. 4 and that the reinforcing sheet is on the inner surface of the inner top panel flap.

Fabrication of the carrier is by standard means, with the blank being folded along the fold lines 44, 46 and 48 to bring the top panel flaps 16 and 18 together and then overlapping and gluing the top panel flaps in the stippled area 60 of the blank of FIG. 4. The end panel flaps 22 extending from the outer top panel flap 16 are thus adhered to the end panel flaps 22 extending from the inner top panel flap 18 to form the upper end panel flaps extending from the top panel. The end panels are formed in the usual manner by first folding the dust flaps 26 nd 28 and then the end panel flaps down and gluing the end panel flaps to the dust flaps.

Figure 5:
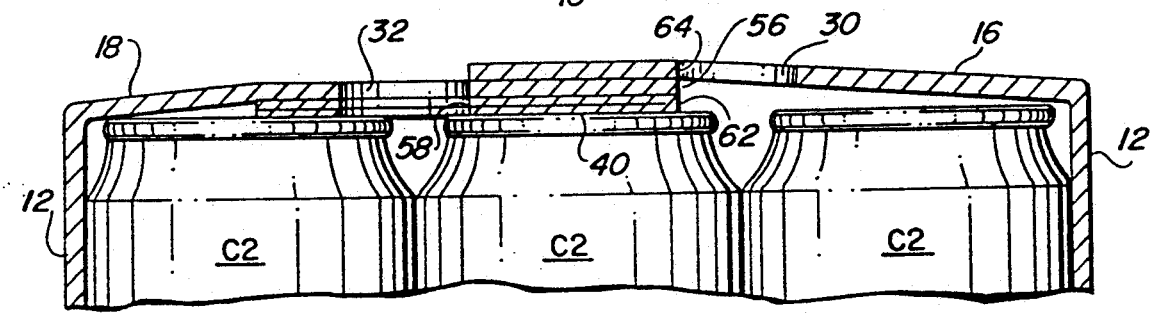
FIG. 5 is an enlarged sectional view of the area enclosed by the oval 5 in FIG. 2.

As shown in FIG. 5, the reinforcing sheet 40 preferably is comprised of a thinner sheet than the material from which the carrier is formed, and is folded over upon itself to provide a fold 62. The fold 62 is aligned with the edge 56 of the inner top panel flap 18, and both are aligned with the inner edge 64 of the cutout 30. This edge is referred to in the claims as the remote side edge of the cutout 30, referring to the arrangement whereby this edge of the cutout is farthest from the side panel to which the inner top panel flap 18 is connected. This design strengthens the strap portion due to the extra thickness of material in this region and also prevents tearing along the cutout edge 64 as well as in areas of the top panel flap 16 which would normally be at risk to a tear originating at this critical juncture in the handle area. This is thought to be due to the fact that a fold acts as a surface rather than an edge, and just as it is considerably more difficult to initiate a tear at a surface than at an edge, the folded reinforcement strip makes it difficult to initiate a tear along this lifting edge of the handle opening. This design additionally provides a cushioning effect for the hand of a user. For purpose of illustration the thickness of the carrier material has been exaggerated. It will be understood, therefore, that in actual practice the thickness of the strap portion of the handle between the openings 30 and 32 will not be as great with respect to the height of the cans as shown, and the top panel flaps 16 and 18 will be in contact with more, if not all, of the top surface of adjacent cans.

Figure 6:
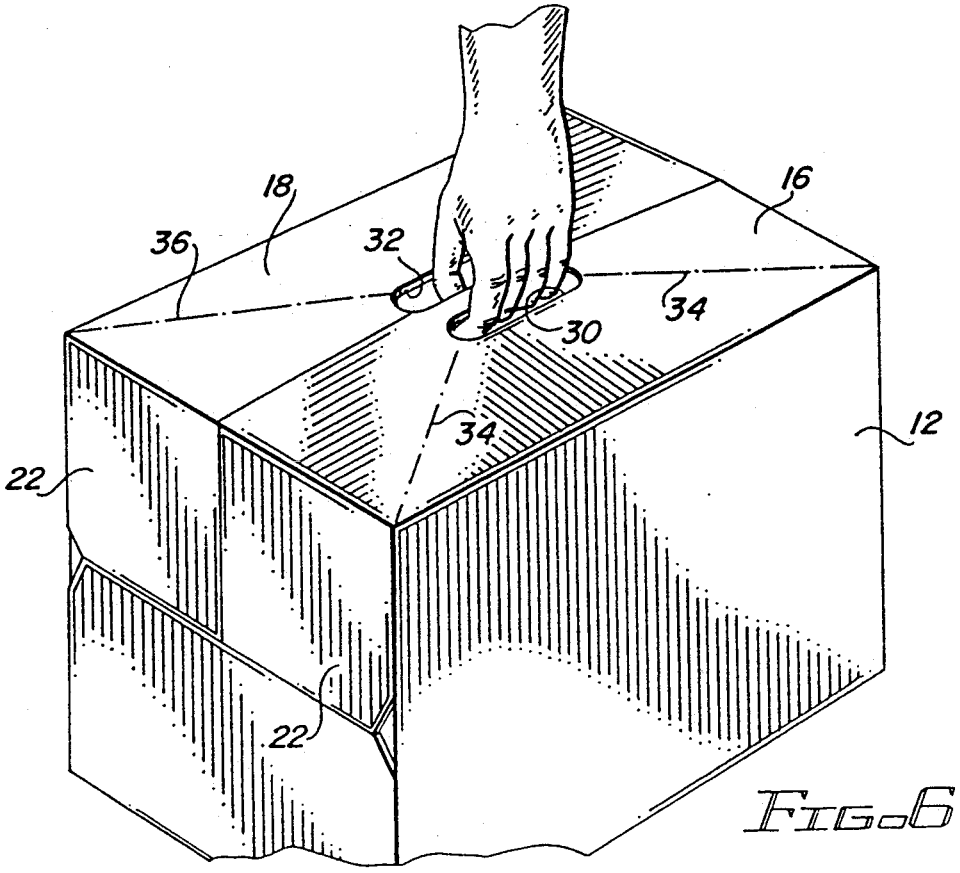
FIG. 6 is a pictorial view of the carrier of the invention illustrating the distortion of the top panel while being lifted or carried.

As will be appreciated, there is little room for the fingers of a user to maneuver when trying to get a grip on the handle strap due to the close proximity of the tops of the cans to the top panel. The design of the invention anticipates upward movement of the top panel as the fingers pull up on the handle while first gripping the strap portion and during lifting and carrying. As shown in FIG. 6, the top panel is adapted to smoothly bow upwardly without tearing at critical areas which normally receive most of the lifting stresses. This is accomplished by the stress relief score lines 34 and 36 which extend from the ends of the handle cutouts to the side panels. Preferably, as illustrated, these lines extend to the corners of the package, thereby transmitting the lifting stresses to the corner folds.

The benefit of the carrier design of the invention can be better understood by comparing a carrier of the invention which is adapted to carry 24 standard 12-fluid ounce beverage cans to a sleeve-type carrier adapted to carry only 12 of the same cans. In the 12-can prior art carrier the cans are arranged with their ends against the side panels in three rows of four cans each. The length of the package is thus approximately equal to four can diameters, the height to three can diameters and the width to one can length. In the 24-can carrier of the invention the cans are arranged with their ends against the top and bottom panels in two stacked layers, each layer being made up of three rows of four cans each. The length of this package is thus approximately equal to four can diameters, the same as the length of the prior art 12-can package. The height of the package is approximately equal to two can lengths and the width of the package is approximately equal to three can diameters. In terms of actual dimensions, this would mean that for a package of the same length as the prior art 12-pack package, a height of only about two inches more and a width of less than three inches more results in twice the carrying capacity. Additional layers of cans or other articles could be packaged simply by making the height of the carrier an additional article length greater.

The handle reinforcement afforded by the suitcase type of handle illustrated in the preferred embodiment resists tearing in this critical area, and the stress relief lines distribute the lifting and carrying stresses from the handle area to the sides, preferably to the corner folds of the carrier. The overlapped portion of the top panel extends beyond the handle area to the ends of the top panel and beyond the top panel through the upper end panel flaps connected to the top panel. This increases the strength of the end panel flaps which in turn increases the strength of the end panels, allowing them to better resist the lifting stresses which may be distributed to them via the stress relief lines.

One problem that may be encountered in a package formed from two layers of stacked articles, particularly with beverage cans, has to do with the tendency of the upper cans to rotate within the package during movement and handling of the package. When this occurs the bottom edge of an upper can, which normally fits inside the upper rim of an associated lower can, may score the upper surface of the lower can, making it unsightly or creating unwanted aluminum particles. In addition, such rotation can cause damage to the pull tab of the can. Since the carrier wrapper cannot ordinarily be made tight enough to hold the cans against rotation, especially when the package is exposed to high humidity, other means must be employed to prevent it.

Figure 7A:
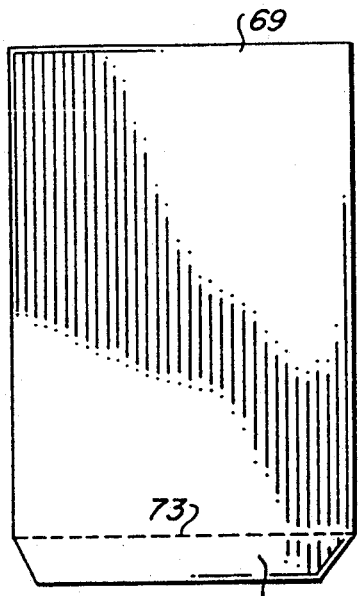
FIG. 7A is a plan view of a planar separator sheet for separating adjacent layers of cans in a carrier.

The use of a divider or separator sheet between the layers in order to prevent direct contact between the ends of stacked cans has been found to be preferred. When a single planar sheet of paperboard is used as a separator sheet, it may remain in planar form in the carrier or the downward forces produced by stacked packages or stacked pallets may cause the cans in the upper layer of a package to be moved down sufficiently to compress the engaged portions of the paperboard sheet. The resulting slightly lower position of the upper cans may create a gap between the tops of the cans in the upper layer and the top panel of the carrier, resulting in some loosening in the package. However, this is normally tolerable and the low cost of the single sheet suggests this is at this time a preferred construction. A planar sheet suitable for use in the invention, which is illustrated in FIG. 7A at reference numeral 69, is of a size to cover the adjacent ends of cans in the upper and lower layers. The sheet 69 includes at least one end strip 71 which is delineated by fold line 73 for a purpose explained below.

Figure 7B:
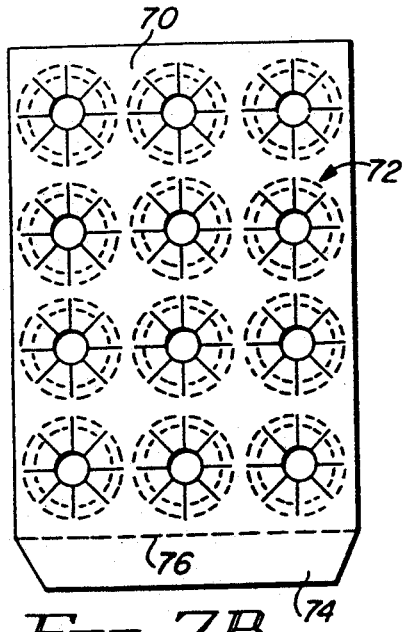
FIG. 7B is a plan view of a separator sheet which includes distortable areas therein.

To prevent contact between the ends of stacked cans while avoiding a construction that may create a gap such as described above, the invention may employ a separator sheet which permits the bottom edges of the upper cans to nest within the recessed upper portions of the lower cans. As shown in FIG. 7B, the sheet 70 is a sheet of paperboard or other suitable compressible and flexible material and may contain a number of circular areas 72 capable of being distorted from the plane of the sheet and designed to be positioned between the ends of stacked cans. Although the illustrated sheet contains twelve distortable areas designed for use in a package holding twenty-four cans, obviously the sheet can be designed for use with any number of cans. The sheet 70, like the sheet 69, includes an end strip 74 similar to the end strip 71, which is delineated by fold line 76 for a purpose explained below.

Figure 8:
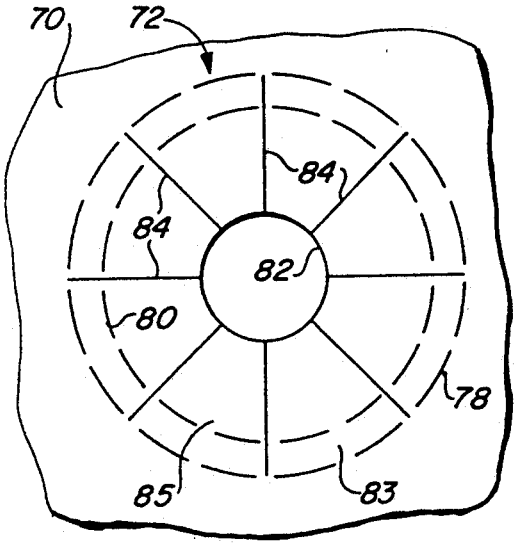
FIG. 8 is an enlarged plan view of one of the distortable areas of a separator sheet.

As better shown in FIG. 8, each area 72 comprises an outer circular fold line 78, a smaller concentric circular fold line 80 and a still smaller concentric circular cutout 82. A number of regularly spaced slits 84 extend from the outer fold line 78 radially inwardly, preferably terminating a short distance from the cutout 82. The area defined by the outer and inner fold lines 78 and 80 and successive slits 84 are transverse panel portions 83, while the area defined by the inner fold line 80, the cutout 82, and successive slits 84, whether or not the slits extend completely to the cutout, are additional panel portions 85.

Figure 9A:
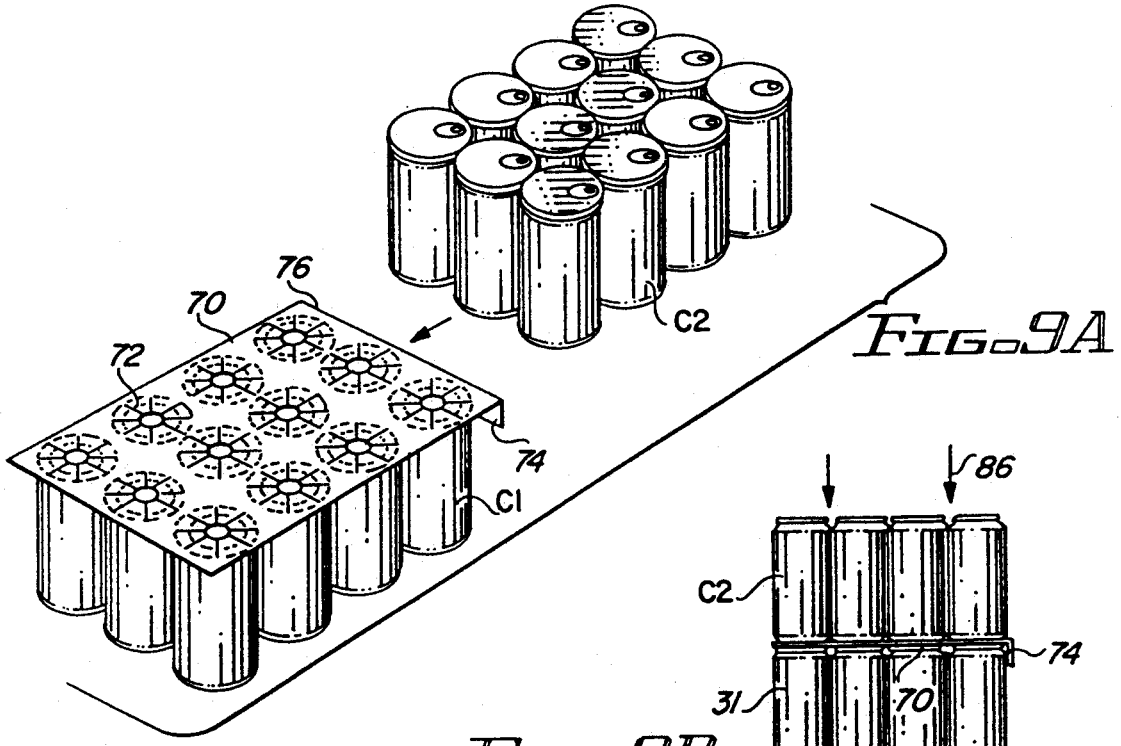
FIG. 9A is a schematic view of an initial stage in the formation of a carrier in which an upper layer of cans is moved into position on a lower layer of cans.

Referring to FIG. 9A, in forming a carrier having a separator sheet containing predefined distortable areas, the sheet 70 is placed on top of an assembled group of cans C1, which are arranged as they would be in a package, so that each distortable area 72 of the sheet overlies the upper end of a can C1 in the lower layer.

An assembled group of cans C2 is then moved into place so as to form an upper layer of cans resting on the areas 72 and thus being aligned with the cans in the lower layer. Preferably, the group of cans C2 is moved laterally onto the lower layer, sliding over the separator sheet 70. The end strip 74 extends beyond the end cans in the lower layer and is gripped or held in place by any suitable means, not shown, in order to stabilize the sheet while the cans of the upper layer are sliding over it. When the end strip 74 is folded down along the fold line 76 through about 90°, a smooth edge is presented to the cans C2 of the upper layer. If this smooth edge were not presented, the cans C2 might "trip" over the raw edge of a divider sheet lacking the end strip 74 and become too unstable to load into the sleeve 10. Note that the same situation exists with respect to sheet 69, and that the end strip 71 is folded down about fold line 73 in the same manner as explained in connection with end strip 74. Further, with respect to the sheet 70, by terminating the slits 84 short of the circular cutout 82, a generally smooth surface is presented to the sliding cans of the upper layer. If the slits 84 extend out to the circular cutout, the edges of the resulting wedge-shaped tabs may act as an obstruction to movement of the upper layer of cans, snagging them and interfering with the rapid formation of a carrier package.

Figure 9B:
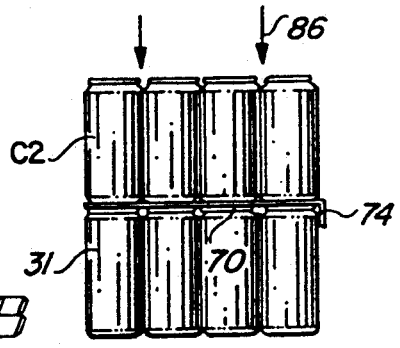
FIG. 9B is a schematic view of an intermediate stage in the formation of a carrier in which force is applied to the upper layer of cans.
Figure 9C:
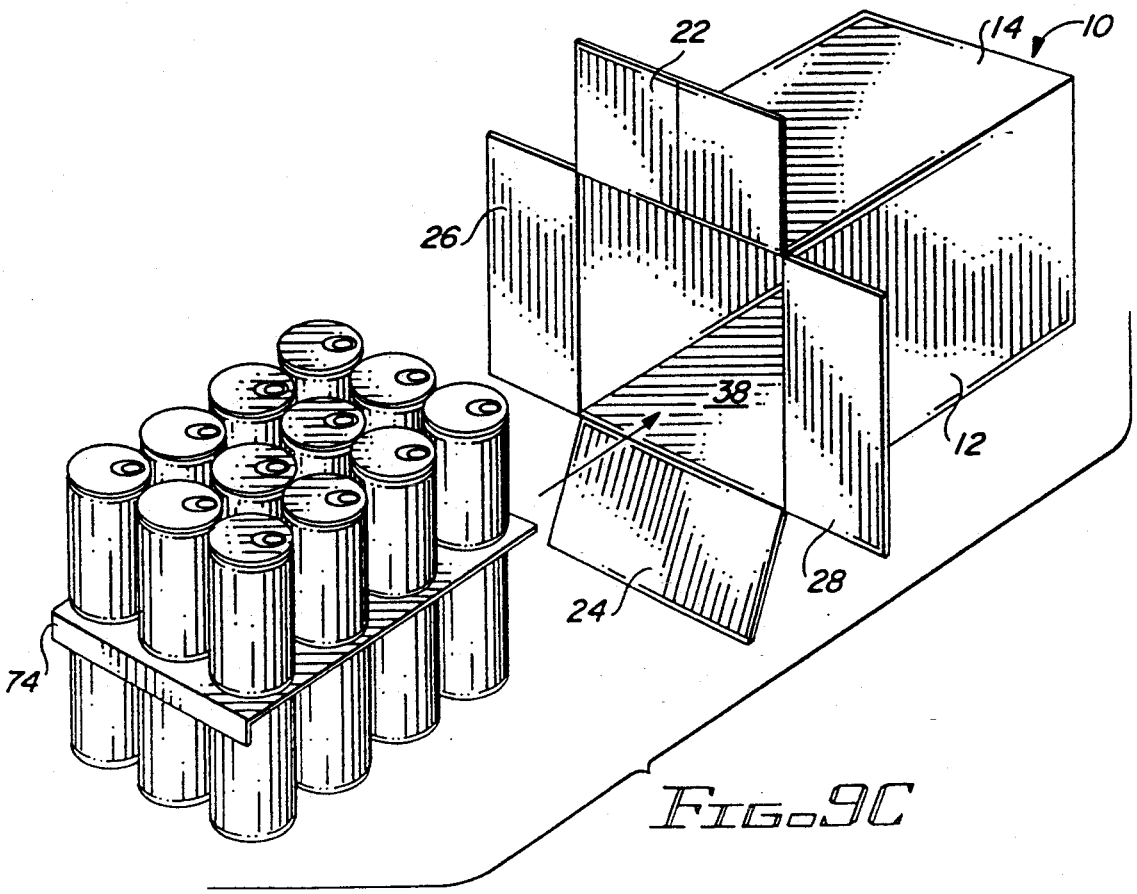
FIG. 9C is a schematic view of a final stage in the formation of a carrier in which the two layers of cans are moved into an open carrier sleeve.

Still referring to the formation of a carrier utilizing a separator sheet 70 having predefined distortable areas, as shown in FIG. 9B, downward force is applied to the cans in the upper layer, as indicated by the force arrows 86, which causes the cans C2 in the upper layer to distort the areas 72 in the separator sheet and nest in the upper portions of the cans Cl. With the cans thus tightly arranged against relative movement, the stacked layers are moved into an open carrier sleeve 10, as shown in FIG. 9C, after which the ends of the sleeve are closed by well known packaging machine mechanisms, not shown.

Figure 10:
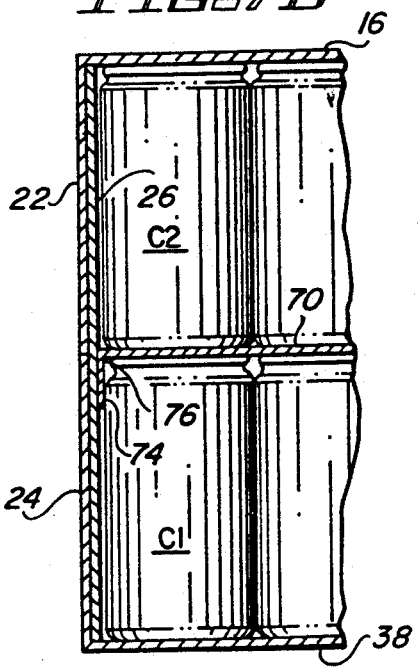
FIG. 10 is a partial longitudinal sectional view of a carrier of the invention, showing the position of the end flap of the separator sheet.

In some cases, the lower layer of cans C1 will be placed in the sleeve 10 with the separator sheet 69 or 70 on top of the cans C1. Then, the cans C2 will be loaded into the sleeve 10 by being pushed over the separator sheet. In addition, some machines load cans from both sides of the sleeve 10, and in such case, the separator sheet would require two end flaps. As illustrated in FIG. 10, the end flap 74 is folded down about the fold line 76, and is in contact with the end panel after formation of the carrier. This would also be the case with the end flap 71 of the sheet 69.

Figure 12:
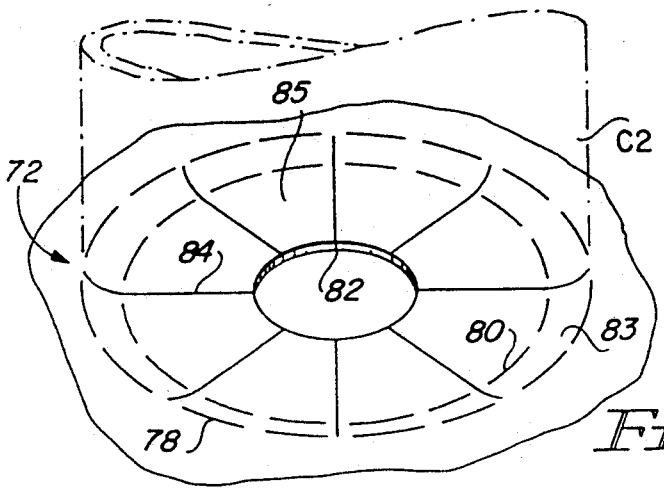
FIG. 12 is a pictorial view of a distortable area of the separator sheet after the application of pressure has distorted it.
Figure 11A:
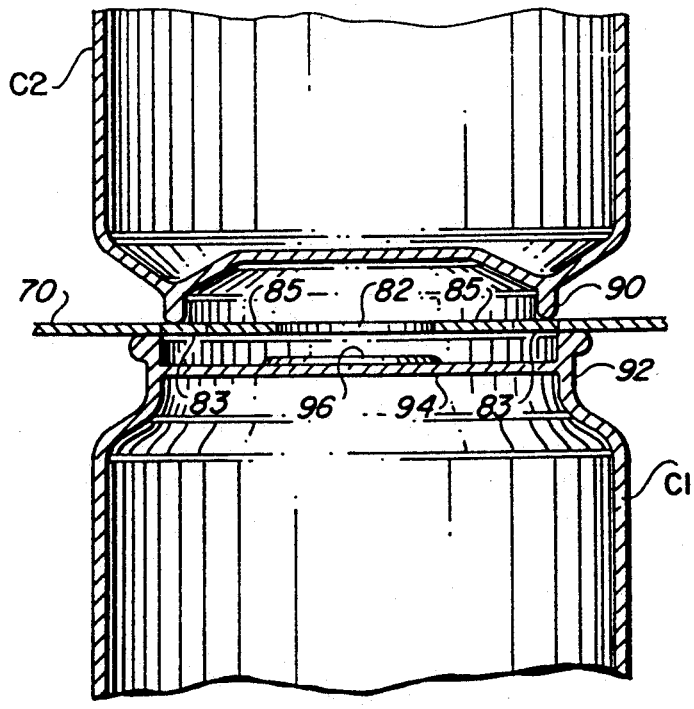
FIG. 11A is an enlarged longitudinal sectional view of a separator sheet in position between upper and lower cans prior to the application of pressure to the upper layer.
Figure 11B:
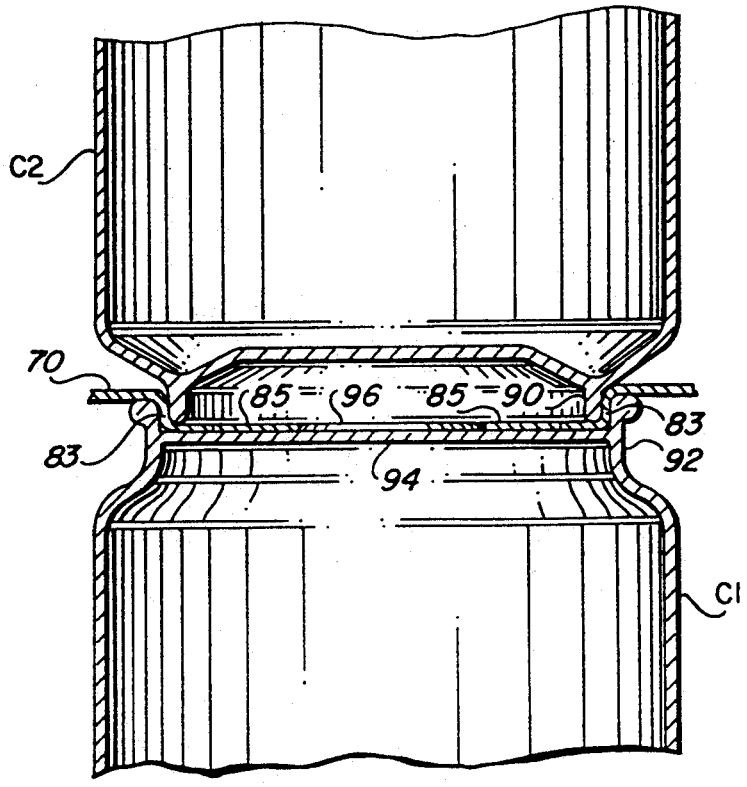
FIG. 11B is an enlarged longitudinal sectional view of the separator sheet and cans of FIG. 11A after pressure has been applied to the upper layer.

The manner in which the areas 72 of the separator sheet are distorted is made more clear by referring to FIGS. 8, 11A, 11B and 12. The relative positions of the upper and lower cans C2 and C1 and the separator sheet 70 are best shown in FIG. 11A, where the bottom rim 90 of the can C2 can be seen to be supported on the transverse panel portions 83 of the distortable area 72 and the separator sheet is supported on the upper rim or chime 92 of the can. The can C1 is illustrated as being of typical construction, with the upper end 94 being recessed with respect to the rim 92 and also carrying a pull tab 96. When the upper layer of cans is pushed down, the rims 90 of the cans C2 push against the transverse panel portions 83 to pivot them down about the fold lines 78. This moves both the transverse panel portions 83 and the additional panel portions 85 out of the plane of the rest of the separator sheet and down into the recess of the can, as shown in FIG. 11B, with the panel portions 85 remaining substantially parallel to the general plane of the sheet 70. The appearance of the area 72 of the separator sheet after being distorted, as it would appear if the cans were not concealing it, is shown in FIG. 12.

It can be appreciated that this aspect of the invention permits separator sheets of economical thickness to be employed while at the same time providing for reliable protection against damage to or marring of the cans. Although the use of separator sheets has been described primarily in connection with the packaging of beverage cans, it will be understood that this aspect of the invention may be employed with other types of articles whose shape permits nesting of the article ends as described above.

Although a specific carrier design has been disclosed which is economical to fabricate, capable of increasing the carrying capacity over prior art carriers while only slightly increasing the carrier size, and protecting the ends of stacked articles from damage, it will be understood that changes to certain features and aspects of the design which do not affect the overall basic function and concept of the invention may be made by those skilled in the art without departing from the spirit and scope of the invention, as defined by the appended claims.

What is claimed is:

1. An article carrier containing a plurality of layers of stacked articles, comprising:

a bottom panel upon which the lowermost of said layers of stacked articles rests;

a top panel positioned above the uppermost of said layers of stacked articles;

a pair of opposed side panels, integrally connected to an extending between said bottom panel and said top panel, said side panels enclosing two sides of said layers of stacked articles;

a pair of opposed end panels extending between said bottom panel and said top panel substantially perpendicular to said side panels and connected to said bottom and top panels to thereby complete the enclosure of said layers of stacked articles;

a separator sheet between adjacent layers of articles, the separator sheet being generally disposed in a primary plane generally parallel to said bottom and top panels;

the articles in each layer having top and bottom ends contacting portions of the separator sheet, the articles in each layer being aligned in end-to-end relationship with the articles in the adjacent layer, the bottom ends of the articles adjacent the separator sheet being narrower than the top ends of the articles in the adjacent layer, said top ends of the articles being recessed;

the portions of the separator sheet contacted by the bottom ends of articles being below the primary plane of the separator sheet, the bottom ends of the adjacent articles and the portions of the separator sheet below the primary plane of the separator sheet extending into the recess and wherein those portions of the separator sheet extending into the recesses include transverse panel portions connected to the separator sheet by a first fold line.

2. The article carrier of claim 1, wherein the carrier contains two layers of stacked articles.

3. The article carrier of claim 1, wherein the separator sheet includes an end flap extending transversely of the sheet and engaging an interior face of an end panel.

4. The article carrier of claim 1, including slits extending inwardly from the first fold line to divide the transverse panels into segments.

5. The article carrier of claim 1, wherein the portions of the separator sheet extending into the recesses include additional panel portions connected to the transverse panel portions by a second fold line.

6. The article carrier of claim 5, including slits extending inwardly from the first fold line to divide the transverse panel portions and the additional panel portions into segments.

7. The article carrier of claim 4, wherein the articles have circular peripheries and the first fold line is circular.

8. The article carrier of claim 7, wherein the articles are beverage cans.

9. The article carrier of claim 6, wherein the articles have circular peripheries and the first and second fold lines are circular.

10. The article carrier of claim 6, including a cutout centrally located in the additional panel portions.

11. The article carrier of claim 13, wherein the slits terminate short of the cutout.

12. The article carrier of claim 10, wherein the articles are beverage cans, the tops of the beverage cans having a tab for opening the can, the tab being aligned with the cutout.

* * * * *